US010140860B2

(12) United States Patent
Agarwal

(10) Patent No.: US 10,140,860 B2
(45) Date of Patent: Nov. 27, 2018

(54) TRAFFIC DIVERSION SIGNALLING SYSTEM AND METHOD

(71) Applicant: Yogesh Agarwal, Haryana (IN)

(72) Inventor: Yogesh Agarwal, Haryana (IN)

( * ) Notice: Subject to any disclaimer, the term of this patent is extended or adjusted under 35 U.S.C. 154(b) by 0 days.

(21) Appl. No.: 15/693,536

(22) PCT Filed: Jan. 14, 2016

(86) PCT No.: PCT/IB2016/050155

§ 371 (c)(1),
(2) Date: Sep. 1, 2017

(87) PCT Pub. No.: WO2016/139542

PCT Pub. Date: Sep. 9, 2016

(65) Prior Publication Data

US 2018/0190114 A1 Jul. 5, 2018

(30) Foreign Application Priority Data

Mar. 3, 2015 (IN) ..... 603/DEL/2015

(51) Int. Cl.
*G08G 1/082* (2006.01)
*G08G 1/083* (2006.01)
(Continued)

(52) U.S. Cl.
CPC ..... *G08G 1/082* (2013.01); *G08G 1/07* (2013.01); *G08G 1/083* (2013.01); *G08G 1/095* (2013.01)

(58) Field of Classification Search
CPC .. G08G 1/00; G08G 1/07; G08G 1/09; G08G 1/095; G08G 1/082; G08G 1/083;
(Continued)

(56) References Cited

U.S. PATENT DOCUMENTS 6,559,774 B2 5/2003 Bergan et al.
6,636,806 B1 * 10/2003 Irie ..... G01C 21/36 340/990

(Continued)

FOREIGN PATENT DOCUMENTS

CN 2687164 3/2005
CN 101736663 5/2011

(Continued)

OTHER PUBLICATIONS

Indian First Examination Report issued in counterpart Indian Patent Application No. 603/DEL/2015 dated Aug. 26, 2016.

(Continued)

*Primary Examiner* — An T Nguyen

(57) ABSTRACT

The present invention provides a traffic diversion system at a traffic intersection which comprises a traffic signal arrangement including a straight-through signal, a stop signal, a custom signal. The traffic diversion system at a traffic intersection further provides for two opposite straight-through signals to open at a time and direct right turn in a left-hand traffic system and a direct left turn in a right-hand traffic system is prohibited. According to an embodiment, the vehicle which intends to take right turn in a left-hand traffic system will be directed using custom signal to take a left turn and a 'U' turn. Similarly, in a right-hand traffic system, the vehicle which intends to take left turn will be directed to take a right turn and a 'U' turn upon the custom signal being enabled.

1 Claim, 9 Drawing Sheets

(51) Int. Cl.
*G08G 1/07* (2006.01)
*G08G 1/095* (2006.01)

(58) Field of Classification Search
CPC ..... G08G 1/087; G08G 1/0965; G08G 1/096716; G08G 1/096725; G01C 21/34
USPC ..... 340/907, 928; 701/117
See application file for complete search history.

(56) References Cited

U.S. PATENT DOCUMENTS

| | | | | |
|---|---|---|---|---|
| 2008/0284616 | A1* | 11/2008 | Rendon | G08G 1/07 340/907 |
| 2011/0243657 | A1* | 10/2011 | Yeo | E01C 1/04 404/1 |
| 2014/0091920 | A1* | 4/2014 | Thompson | B60Q 1/38 340/475 |

FOREIGN PATENT DOCUMENTS

| | | |
|---|---|---|
| CN | 202913323 | 5/2013 |
| DE | 102009008467 | 8/2010 |

OTHER PUBLICATIONS

Indian Hearing Notice issued in counterpart Indian Patent Application No. 603/DEL/2015 dated May 19, 2017.
International Search Report (ISR) along with its Written Opinion and Internationai Preliminary Report on Patentability (IPRP) issued with respect to Application No. PCT/IB2016/050155.

* cited by examiner

TRAFFIC DIVERSION SIGNALLING SYSTEM AND METHOD

FIELD OF THE INVENTION

The present invention generally relates to a system and method for traffic diversion at a traffic intersection of a four phase traffic system and more specifically to a traffic diversion signalling system to enable traffic to flow more easily and efficiently and thus reducing the waiting time at signal crossings, by converting a four phase traffic system to a two phase traffic system.

BACKGROUND OF THE INVENTION

Traffic congestion on road networks is nothing but slower speeds, increased trip time and increased queuing of the vehicles. When the number of vehicles exceeds the capacity of the road, traffic congestion occurs. In the metropolitan cities across the world traffic congestion is a major problem. Traffic congestion is caused when the demand exceeds the available road capacity. There are various reasons which lead to traffic congestion such as failure of signals, poor law enforcement and bad traffic management. One of the major problems with the present traffic system and management across the world is that the existing traffic system cannot be expanded any more. Traffic congestion for any country may lead to negative impact on economy, environment and overall quality of life and developments of the people. The only possible practical option available is to try and implement better management with the existing traffic systems and methods.

There are various conventional systems and methods available for traffic management such as traffic signals are located on roadways to control the flow of traffic through intersections and other areas. A typical traffic signal includes three intervals—a red interval, a green interval, and a yellow interval. With the sustained and rapid economic development across the world, the number of vehicles on roads are increasing dramatically, growing urban road congestion, and thereby traffic congestion has become an international issue. A typical driver spends significant time idling in traffic congestion. Air pollution and energy consumption is becoming more serious due to exhaust gases emitted during the idling of vehicles waiting for traffic signals to change. Furthermore, a lot of this time is spent idling behind traffic signals.

To cope with the traffic congestion problems, multi-level crossings including overpasses and underpasses have been conventionally constructed. However, construction of such alternative crossing structures suffers from various disadvantages such as enormous construction costs, significant maintenance and management expenses, and detrimental effects on the beauty of cities.

According to the traditional four phased traffic signal design, a vehicle in any particular arm has to wait for the other three arms to turn off in order to pass the crossing. If each signal possesses a waiting time of 1 minute, the total waiting time duration sums up to 3 minutes.

Therefore, there exists a need to improve the traffic signalling system and method which can be implemented to improve the flow of traffic smoothly with minimum waiting time for a vehicle at any traffic signal.

Therefore, the present invention has been conceived in view of overcoming the drawbacks discussed above, and it is an object of the present invention to provide an intersection system which is capable of achieving smooth vehicular traffic flow at intersections by simplification of a traffic signal system into a two-phase signal system and is also capable of significantly increasing traffic capacity of intersections by reduction of waiting time.

SUMMARY OF THE INVENTION

The present invention provides a traffic diversion system at a traffic intersection of a four phase traffic system which comprises a traffic signal arrangement including a straight-through signal, a stop signal, a custom signal. The traffic diversion system at a traffic intersection provides provision for two straight-through signals to open at a time and direct right turn is prohibited in a left-hand traffic system and similarly, direct left turn is prohibited in a right-hand traffic system, in order to avoid conflict with straight through traffic.

According to an exemplary embodiment of the present invention, the traffic signal arrangement provides a provision for diverging vehicles which intends to turn right in a left-hand traffic system, by directing the vehicles to first take a left turn and then a 'U' turn upon the custom signal being enabled in such a way to avoid conflict with intersecting traffic and to orient themselves in a waiting/moving position for the straight-through signal to be enabled.

According to an exemplary embodiment of the present invention, the traffic signal arrangement provides a provision for diverging vehicles which intend to turn left in a right-hand traffic system, by directing the vehicles to first take a right turn and then a 'U' turn upon the custom signal being enabled in such as way to avoid conflict with intersecting traffic and to orient themselves in a waiting/moving position for the straight-through signal to be enabled.

BRIEF DESCRIPTION OF THE DRAWINGS

The advantages and features of the present invention will be better understood with reference to the following detailed description and claims taken in conjunction with the accompanying drawing, in which:

DETAILED DESCRIPTION OF THE INVENTION

The exemplary embodiments described herein detail for illustrative purposes are subject to many variations in structure, design and layout. It should be emphasized, however, that the present invention is not limited to a particular structure, design and layout as shown and described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting.

The exemplary mode for carrying out the invention is presented in terms of its exemplary embodiments. However, the exemplary embodiments described herein detail for illustrative purposes and are subject to many variations. It is understood that various omissions and substitutions of equivalents are contemplated as circumstances may suggest or render expedient, but are intended to cover the application or implementation without departing from the spirit or scope of the present invention.

The terms "a" and "an" herein do not denote a limitation of quantity, but rather denote the presence of at least one of the referenced item.

Figure 1:
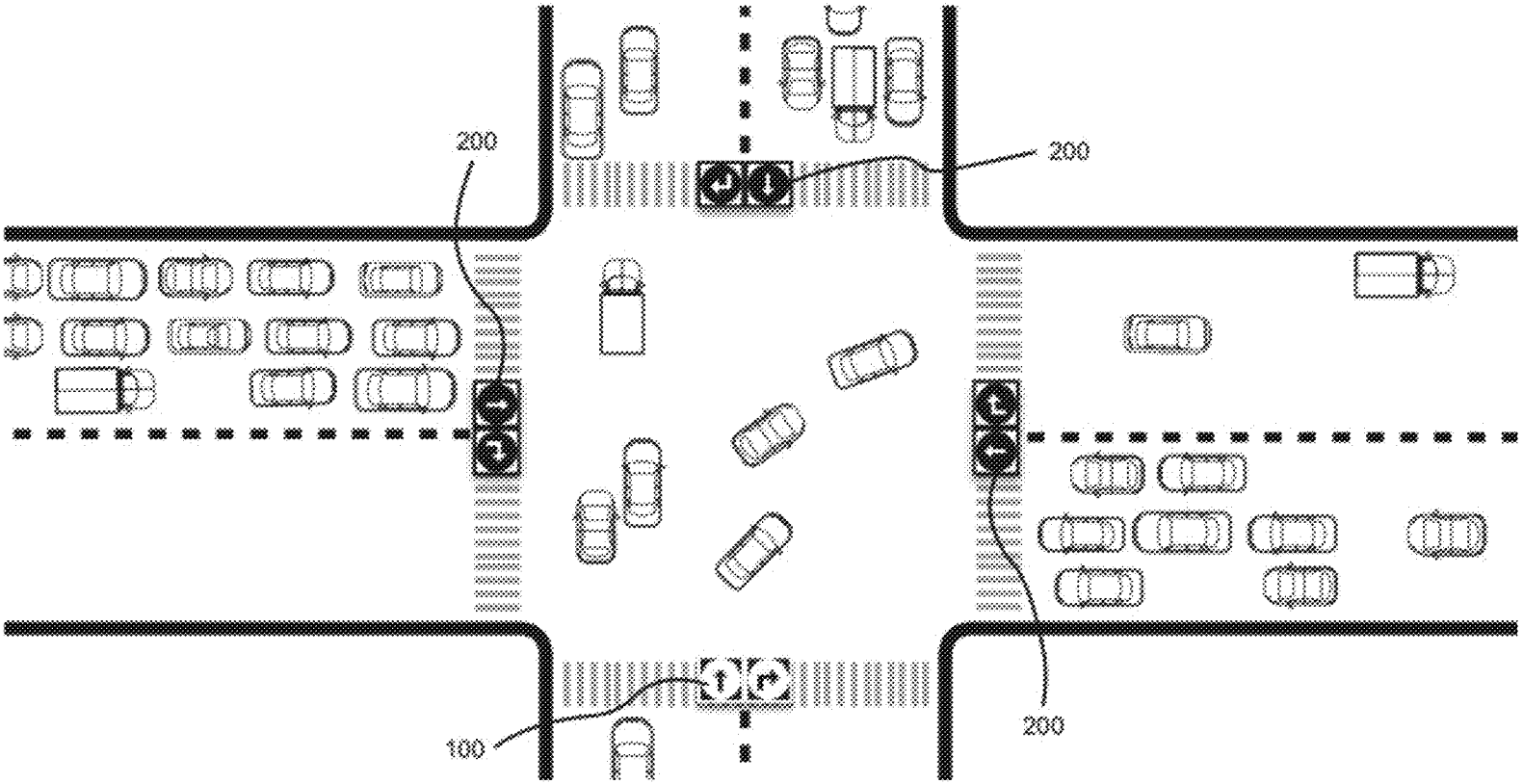
Fig 1 (Prior Art)
FIGS. 1, 2 and 3 illustrate a traditional four way traffic signal design.
Figure 2:
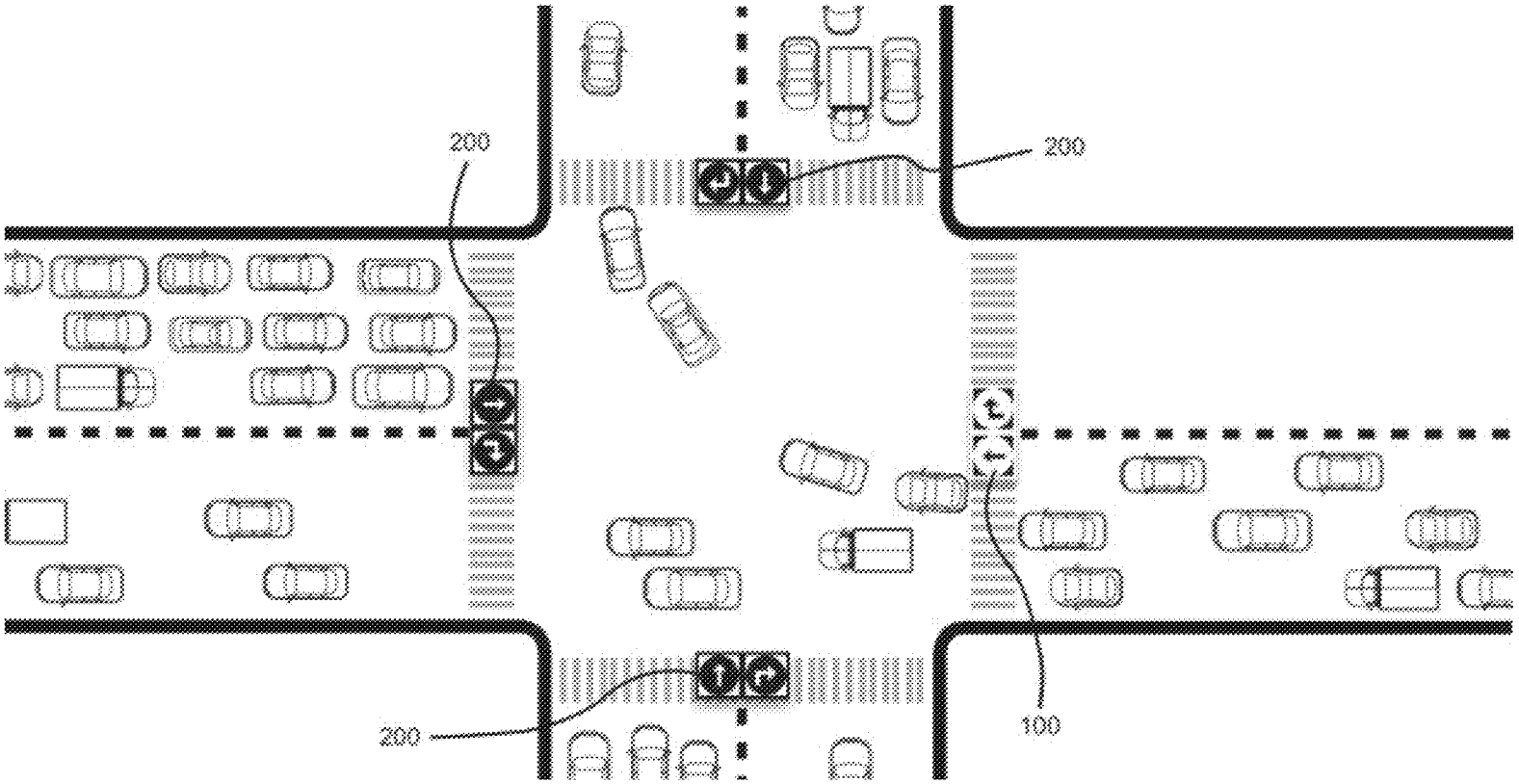
Fig 2 (Prior Art)
Figure 3:
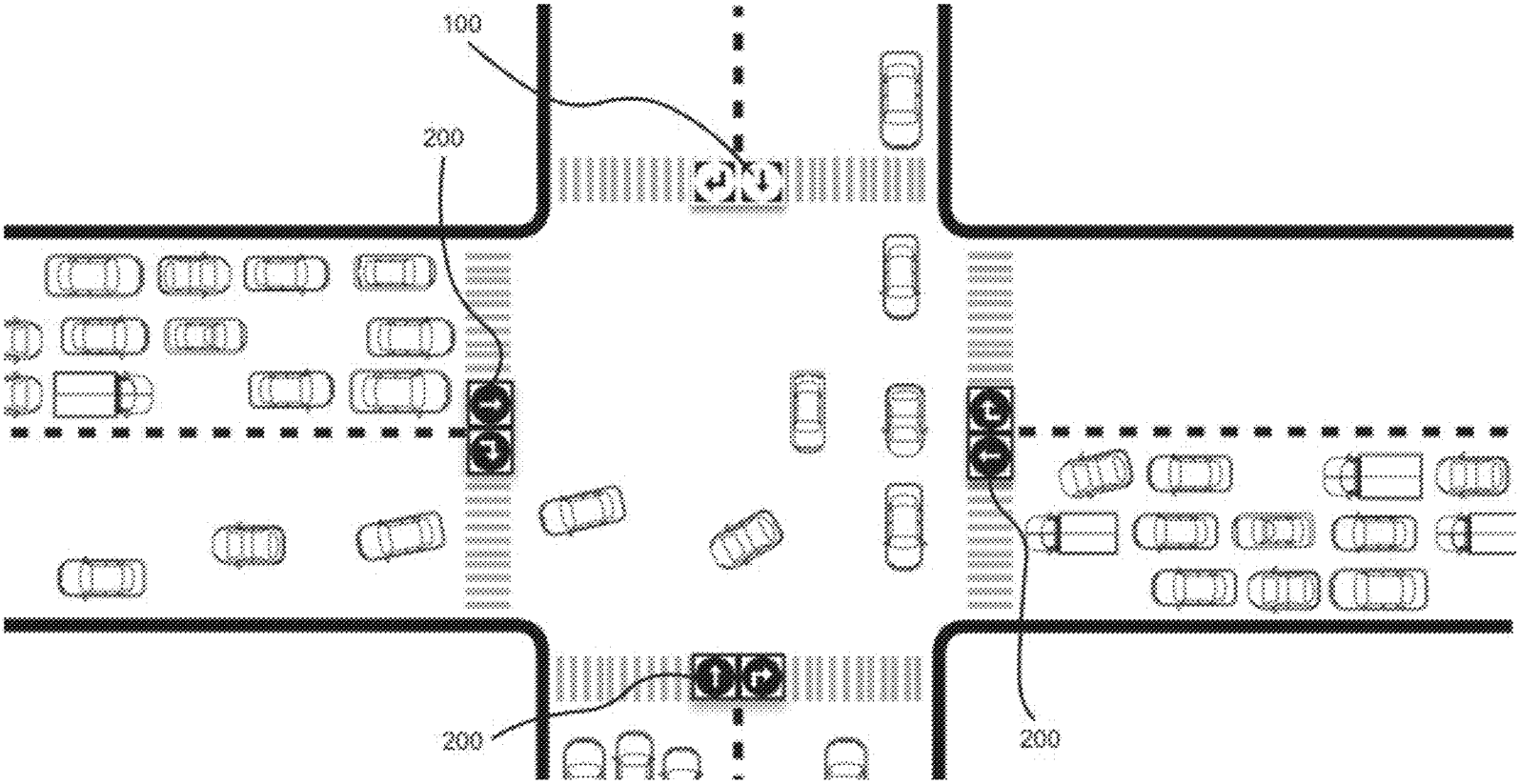
Fig 3 (Prior Art)

FIGS. 1, 2, & 3 illustrates a traditional four way traffic signal system in which a vehicle in any particular arm has to wait for the signals of the other three lanes to turn off in order to pass the crossing. As illustrated one straight-through signal is open (100) and the other three straight-through signals being closed (200). If each signal possesses a waiting time of 1 minute, than the total waiting time duration sums up to 3 minutes.

Figure 4:
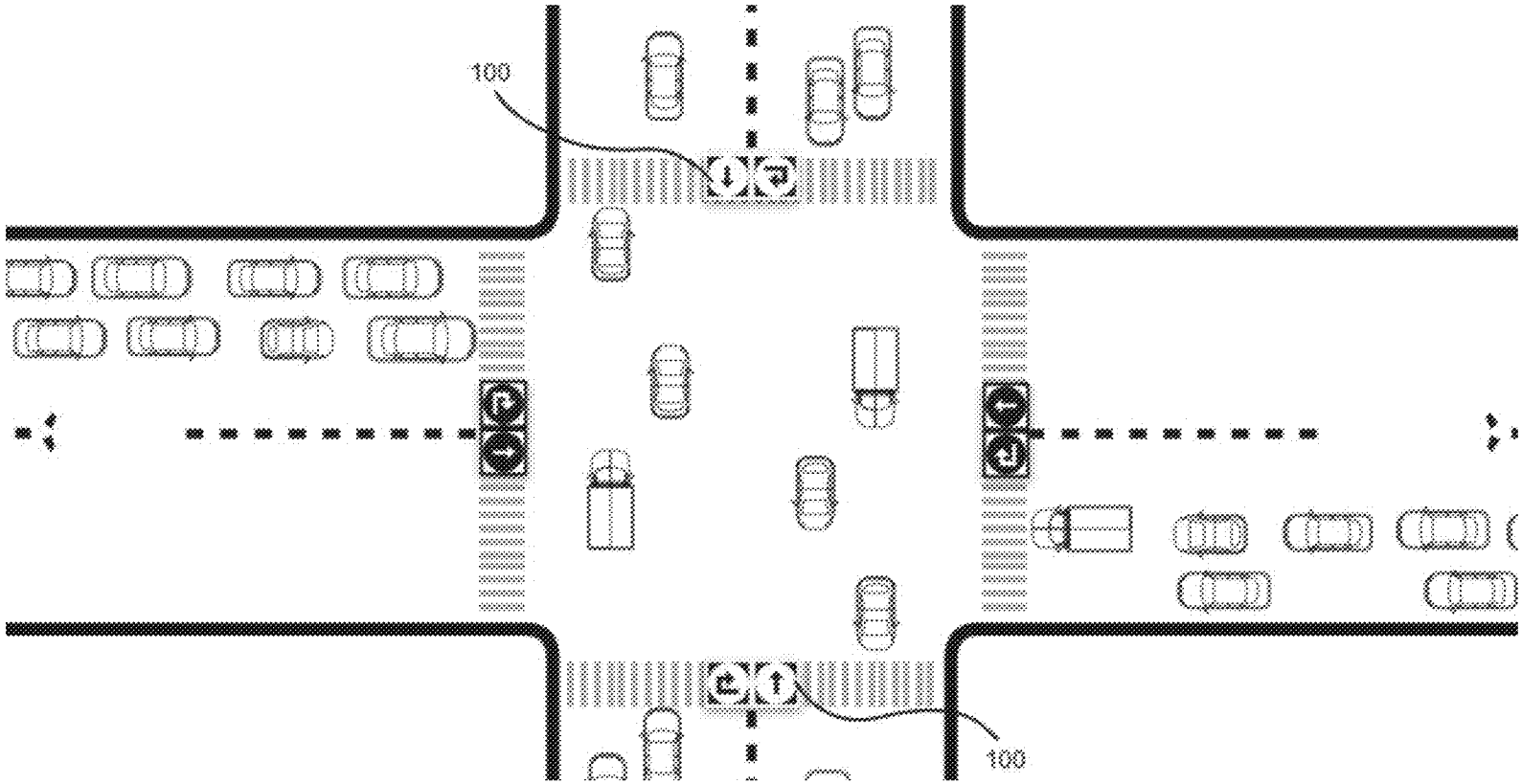
FIG. 4 illustrates a traffic signalling design in which two opposite straight-through signals are open at a time and direct right turn is prohibited in a left-hand traffic system.

FIG. 4 illustrates one of the aspects of the traffic signalling design in which two opposite straight-through signals (100) being open at a time and a vehicle has to wait for just 1 arm to pass for its turn which reduces the waiting time to 1 minute from 3 minutes. Furthermore, there would be no right turns in a left-hand traffic system and no left turns in a right-hand traffic system on the crossings so that two opposite straight-through signals being allowed to pass at the same time.

Figure 5:
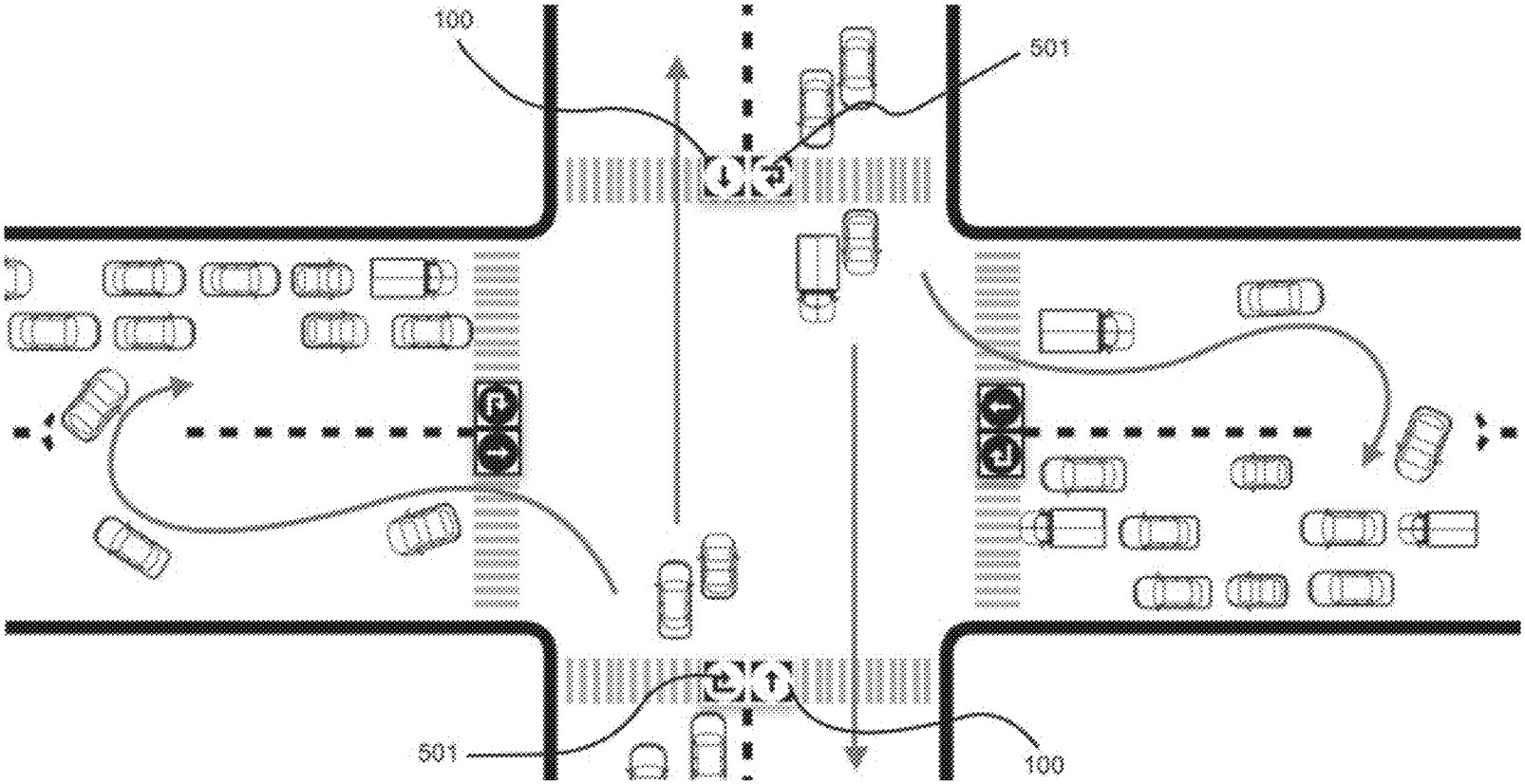
FIG. 5 illustrates a traffic signalling design in which two opposite straight-through signals are open at a time, direct right turn is prohibited and vehicles intending to take right turn are directed to take a left turn and a U turn using custom signal in a left-hand traffic system.

FIG. 5 illustrates the proposed traffic signalling design at a traffic intersection comprising a traffic signalling arrangement including a straight-through signal, a stop signal, a custom signal which provides a provision for two opposite straight-through signals being allowed to pass at the same time (i.e. open). Further, the traffic diversion system according to an embodiment provides a provision for diverging the route for the vehicles intending to turn right in a left-hand traffic system by allowing them to take a left-turn and a U turn using custom signal (501) in such a way to avoid conflict with intersecting traffic.

Figure 6:
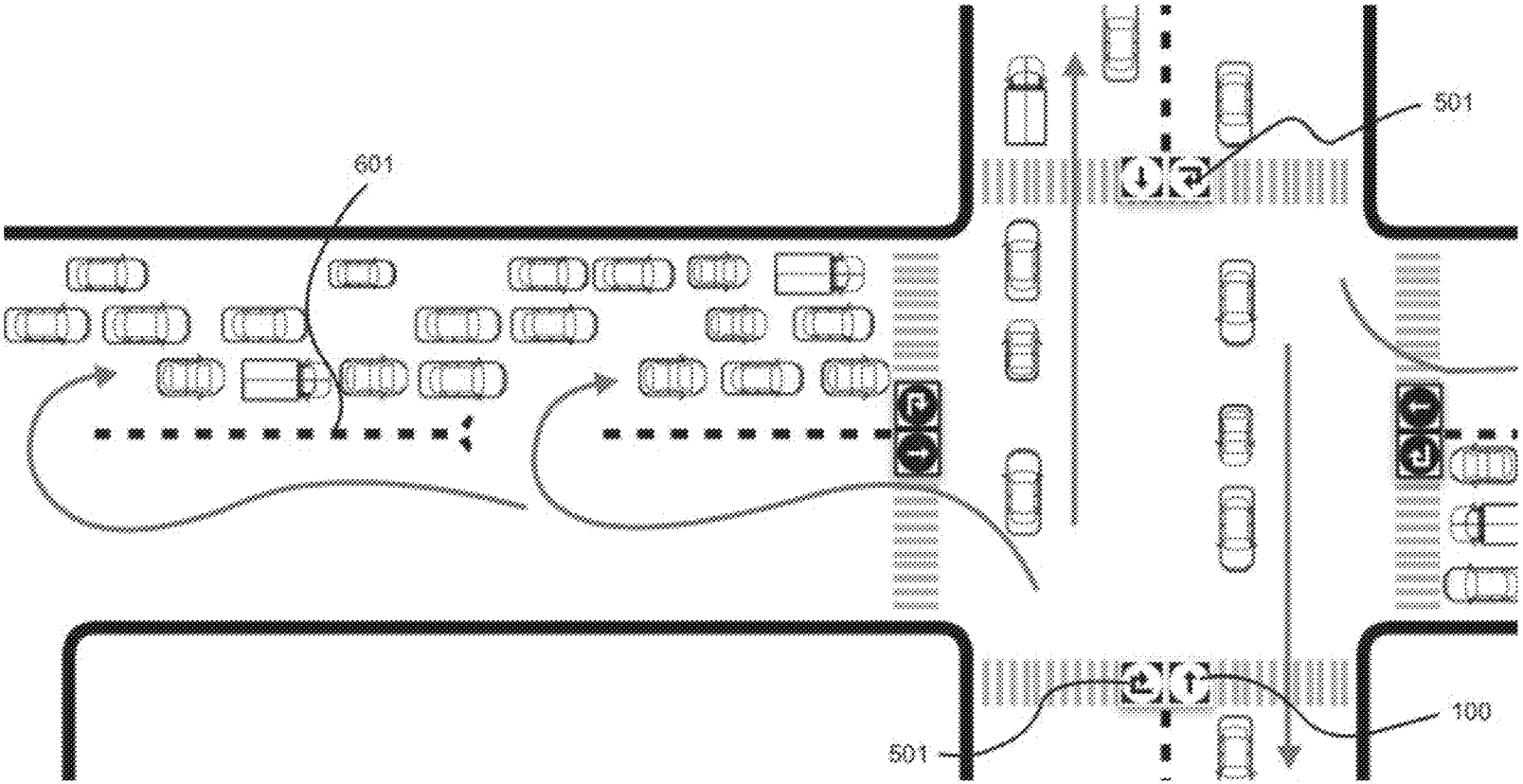
FIG. 6 illustrates a traffic signalling design with multiple custom turn by the bidirectional divider (601).

FIG. 6 illustrates another aspect of the proposed traffic signalling design as illustrated in FIG. 5 in which multiple 'U' turns is provided by the bidirectional divider (601) so that any vehicles intended to take custom turn can easily cross through any of the 'U' turns along bidirectional divider (601).

Figure 7:
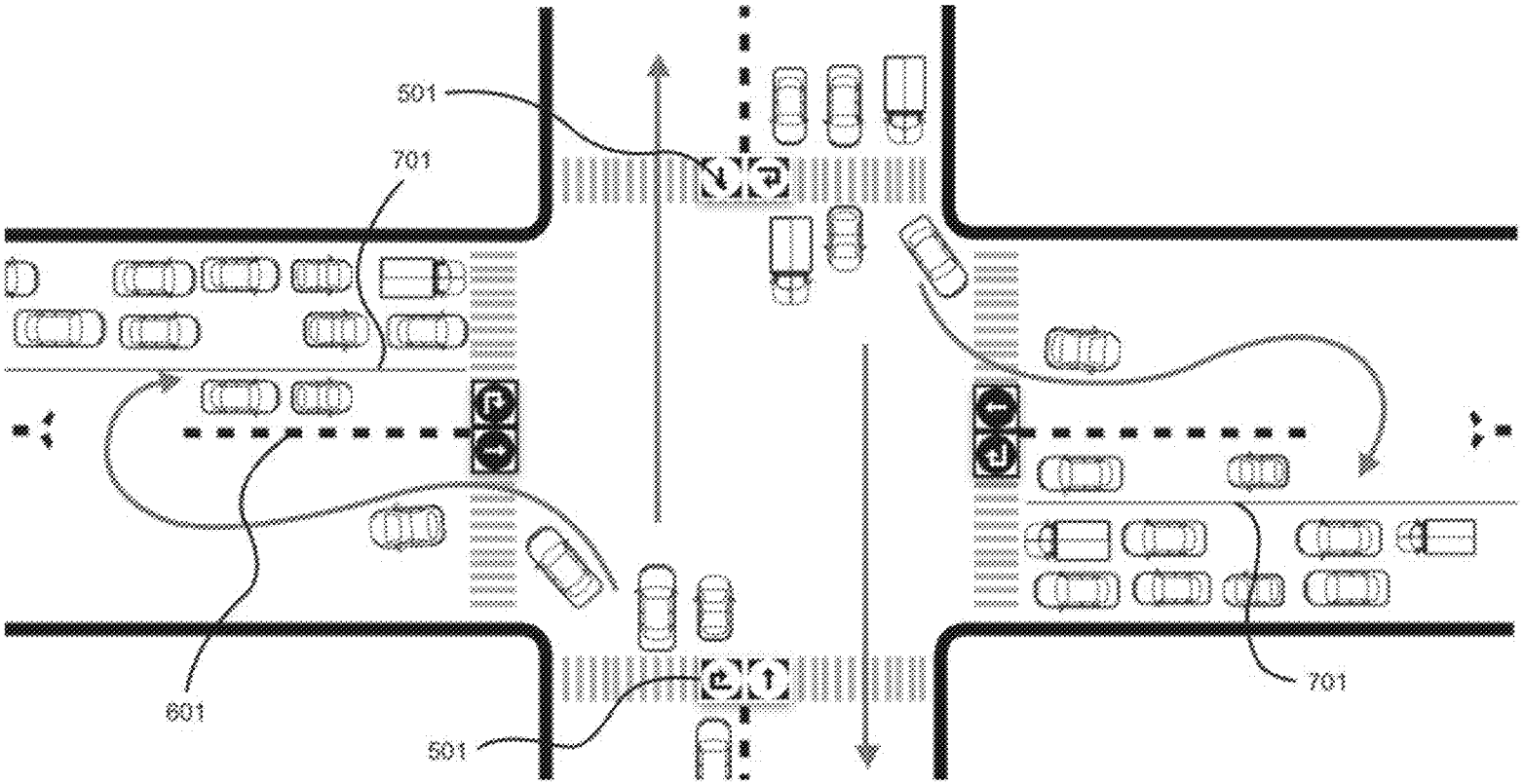
FIG. 7 illustrates a traffic signalling design with a provision of a separate lane for the vehicles taking custom turn.

FIG. 7 illustrates another aspect of the proposed traffic signalling design at a traffic intersection in which an optional separate lane (701) is provided for the vehicles which takes custom turns when the custom signal (501) is open and enters into the separate lane (701) through the 'U' turn cuts to avoid conflicting traffic from behind. Further, the separate lane (701) can be formed by road markings or the separate lane (701) can be formed using the road barrier. Furthermore, the separate lane (701) is an optional element and may only be implemented depending upon the width of the road.

Figure 8:
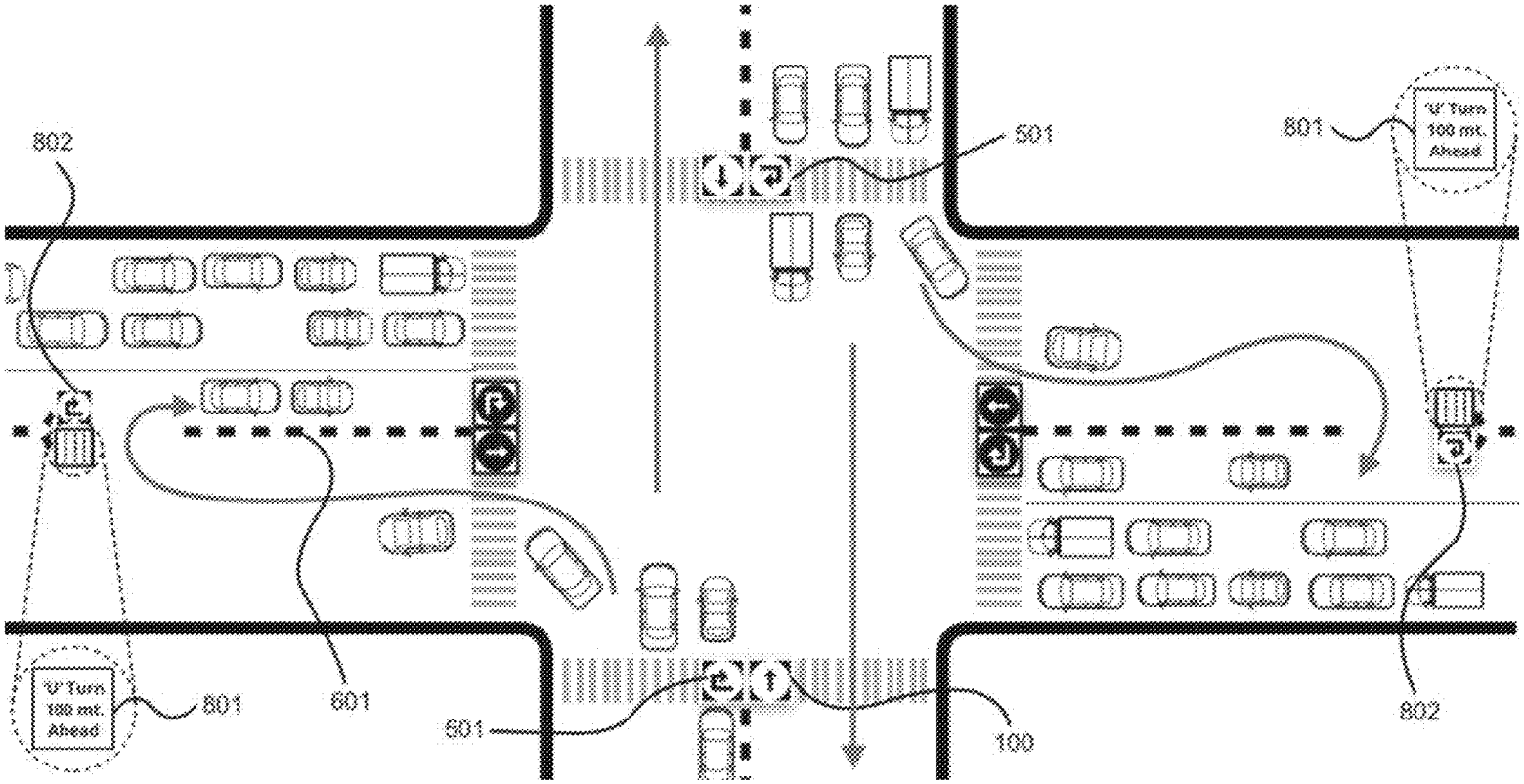
FIG. 8 illustrates a traffic signalling design with a 'U' turn indicator at the custom turn along the bidirectional divider.

FIG. 8 illustrates another aspect of the proposed traffic signalling design in which a 'U' turn indicator (802) has the provision to display (801) the position of subsequent 'U' turn ahead. For example, if a vehicle which intended to turn right, first take left turn 'when the custom signal (501) is open (green signal) and thereby tries to enter into the first custom turn. To avoid traffic congestion on a single 'U' turn (802), the 'U' turn indicator (802) may also provide with the display (801) which shows the availability of subsequent 'U' turn ahead such as "U turn 100 meters ahead".

Figure 9:
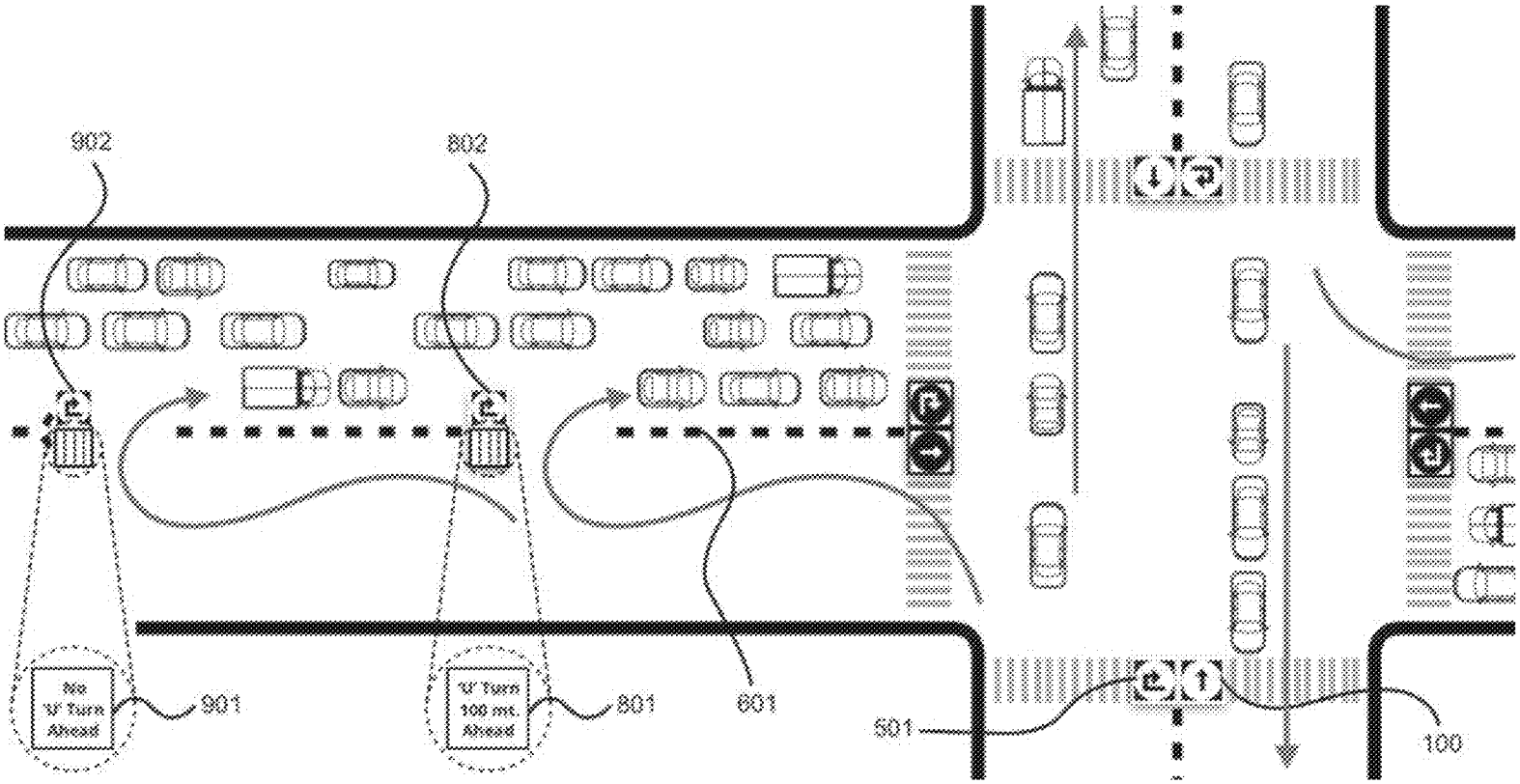
FIG. 9 illustrates a traffic signalling design with multiple 'U' turn indicator(s) at the custom turn along the bidirectional divider.

FIG. 9 illustrates yet another aspect of the proposed signalling design which may have multiple 'U' turns indicators (802 & 902) at the custom turns along the bidirectional divider (601). Further, the display (801) at the first 'U' turn indicator (802) may display as "U turn 100 meters ahead". Subsequent 'U' turn indicator (902) may display as "No U turn ahead". In FIG. 9, only two U turn indicators (802 & 902) are shown. However, the present invention is not limited to only two 'U' turns indicators and there may be multiple 'U' turns indicators at the custom turns along the bidirectional divider (601).

The present invention increases the probability of finding green lights on the traffic signals. According to traditional design, a light would turn green 15 times in one hour (assuming a waiting time of 3 minutes). However, according to the present invention, a signal would turn green 30 times in one hour, thus increasing the frequency of green signals and reducing traffic congestion.

The foregoing descriptions of exemplary embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated. It is understood that various omissions, substitutions of equivalents are contemplated as circumstance may suggest or render expedient, but is intended to cover the application or implementation without departing from the spirit or scope of the present invention.

What is claimed is:

1. A traffic diversion system at a traffic intersection, comprising:

a traffic signal arrangement including a straight-through signal, a stop signal, and a custom signal (501);

wherein the traffic signal arrangement provides for two opposite straight-through signals being open at a time, wherein the traffic signal arrangement enables diverging vehicles intending to turn right in a left-hand traffic system, by directing the vehicles using custom signal (501) to take a left turn and a 'U' turn in such a way to avoid conflict with intersecting traffic and orient themselves in a waiting/moving position for the straight-through signal to be open, and wherein the traffic signal arrangement enables diverging vehicles intending turn left in a right-hand traffic system, by directing the vehicles using custom signal to take a right turn and a 'U' turn in such a way to avoid conflict with intersecting traffic and orient themselves in a waiting/moving position for the straight-through signal to be open.

* * * * *